US009453714B2

(12) United States Patent
Bosarge et al.

(10) Patent No.: US 9,453,714 B2
(45) Date of Patent: Sep. 27, 2016

(54) METHOD FOR PRODUCING SUBSONIC AMMUNITION CASING

(71) Applicant: MAC, LLC, Bay Saint Louis, MS (US)

(72) Inventors: John Francis Bosarge, Pearlington, MS (US); Nikica Maljkovic, New Orleans, LA (US)

(73) Assignee: MAC, LLC, Bay Saint Louis, MS (US)

( * ) Notice: Subject to any disclaimer, the term of this patent is extended or adjusted under 35 U.S.C. 154(b) by 0 days.

(21) Appl. No.: 14/679,732

(22) Filed: Apr. 6, 2015

(65) Prior Publication Data

US 2015/0285604 A1 Oct. 8, 2015

Related U.S. Application Data

(60) Provisional application No. 61/975,497, filed on Apr. 4, 2014.

(51) Int. Cl.
*F42B 33/02* (2006.01)

(52) U.S. Cl.
CPC ..... *F42B 33/0207* (2013.01)

(58) Field of Classification Search
USPC ..... 86/10, 18
See application file for complete search history.

(56) References Cited

U.S. PATENT DOCUMENTS

| | | | |
|---|---|---|---|
| 2,455,080 | A | 11/1948 | Miller |
| 3,060,856 | A | 10/1962 | Dunn |
| 3,144,827 | A | 8/1964 | Boutwell |
| 3,175,901 | A | 3/1965 | Jesmont et al. |
| 3,485,170 | A | 12/1969 | Scanlon |
| 3,609,904 | A | 10/1971 | Scanlon |
| 3,675,576 | A | 7/1972 | Whitney |
| 3,745,924 | A | 7/1973 | Scanlon |
| 3,749,023 | A | 7/1973 | Kawaguchi et al. |
| 3,989,017 | A | 11/1976 | Reece |
| 3,989,792 | A | 11/1976 | San Miguel |
| 3,990,366 | A | 11/1976 | Scanlon |
| 4,065,437 | A | 12/1977 | Blinne et al. |

(Continued)

FOREIGN PATENT DOCUMENTS

| | | | |
|---|---|---|---|
| DE | 2705235 | A1 | 8/1978 |
| DE | 4015542 | A1 | 11/1991 |

(Continued)

OTHER PUBLICATIONS

International Search Report and Written Opinion for International Application No. PCT/US2008/072810, completed Oct. 19, 2008, 9 pgs.

(Continued)

*Primary Examiner* — Troy Chambers
*Assistant Examiner* — Joshua Semick
(74) *Attorney, Agent, or Firm* — KPPB LLP

(57) ABSTRACT

Apparatus and methods for manufacturing subsonic ammunition articles from conventional supersonic ammunition articles are provided. The apparatus includes devices for controllably introducing a filler material to reduce the inner volume of a conventional supersonic ammunition article. Method are also provided for converting a conventional supersonic ammunition article to a subsonic ammunition article including defining a new subsonic propellant volume within said conventional supersonic ammunition article and controllably introducing a filler material therearound.

19 Claims, 7 Drawing Sheets

(56) References Cited

U.S. PATENT DOCUMENTS 4,108,837 A 8/1978 Johnson et al.
4,147,107 A 4/1979 Ringdal
4,157,684 A * 6/1979 Clausser ..... F42B 5/02 102/430
4,175,175 A 11/1979 Johnson et al.
4,228,218 A 10/1980 Takayanagi et al.
4,308,847 A 1/1982 Ruizzo
4,326,462 A 4/1982 Garcia et al.
4,565,131 A 1/1986 Buchner
4,569,288 A 2/1986 Grelle et al.
4,574,703 A 3/1986 Halverson
4,614,157 A 9/1986 Grelle et al.
4,711,271 A 12/1987 Weisenbarger et al.
4,726,296 A 2/1988 Leshner et al.
4,809,612 A 3/1989 Ballreich et al.
4,839,435 A 6/1989 Gergen et al.
4,867,065 A 9/1989 Kaltmann et al.
4,897,448 A 1/1990 Romance
4,958,567 A 9/1990 Olson
4,969,386 A 11/1990 Sandstrom et al.
5,033,386 A 7/1991 Vatsvog
5,062,343 A * 11/1991 Sjoberg ..... F42B 33/02 86/20.1
5,129,382 A 7/1992 Stamps et al.
5,151,555 A 9/1992 Vatsvog
5,161,512 A 11/1992 Adam et al.
5,175,040 A 12/1992 Harpell et al.
5,190,018 A 3/1993 Costello et al.
5,196,252 A 3/1993 Harpell
5,227,457 A 7/1993 Marrocco, III et al.
5,259,288 A 11/1993 Vatsvog
5,404,913 A 4/1995 Gilligan
5,434,224 A 7/1995 McGrail et al.
5,471,905 A 12/1995 Martin
5,496,893 A 3/1996 Gagne et al.
5,512,630 A 4/1996 Gagne et al.
5,519,094 A 5/1996 Tseng et al.
5,539,048 A 7/1996 Gagne et al.
5,558,765 A 9/1996 Twardzik
5,565,543 A 10/1996 Marrocco et al.
5,585,450 A 12/1996 Oaks et al.
5,616,650 A 4/1997 Becker et al.
5,625,010 A 4/1997 Gagne et al.
5,637,226 A 6/1997 Adam et al.
5,646,231 A 7/1997 Marrocco, III et al.
5,646,232 A 7/1997 Marrocco, III et al.
5,654,392 A 8/1997 Marrocco, III et al.
5,659,005 A 8/1997 Marrocco, III et al.
5,668,245 A 9/1997 Marrocco et al.
5,670,564 A 9/1997 Gagne et al.
5,691,401 A 11/1997 Morita et al.
5,721,335 A 2/1998 Marrocco, III et al.
5,731,400 A 3/1998 Marrocco, III et al.
5,755,095 A 5/1998 Maurer
5,756,581 A 5/1998 Marrocco, III et al.
5,760,131 A 6/1998 Marrocco, III et al.
5,770,815 A * 6/1998 Watson, Jr. ..... F42B 5/16 102/439
5,789,521 A 8/1998 Marrocco, III et al.
5,822,904 A 10/1998 Beal
5,824,744 A 10/1998 Gagne et al.
5,827,527 A 10/1998 Leonard
5,827,927 A 10/1998 Gagne et al.
5,830,945 A 11/1998 Gagne et al.
5,869,592 A 2/1999 Gagne et al.
5,886,130 A 3/1999 Trimmer et al.
5,976,437 A 11/1999 Marrocco, III et al.
6,087,467 A 7/2000 Marrocco, III et al.
6,135,097 A 10/2000 Ruizzo, Jr. et al.
6,228,970 B1 5/2001 Savariar
6,283,035 B1 * 9/2001 Olson ..... F42B 5/02 102/439
6,367,441 B1 4/2002 Hoshiba et al.
6,387,985 B1 5/2002 Wilkinson et al.
6,441,099 B1 8/2002 Connell et al.
6,525,125 B1 2/2003 Giardello et al.
6,528,145 B1 3/2003 Berger et al.
6,586,554 B1 7/2003 Takahashi
6,630,538 B1 10/2003 Ellul et al.
6,752,084 B1 6/2004 Husseini et al.
6,845,716 B2 1/2005 Husseini et al.
7,610,858 B2 11/2009 Chung
7,992,498 B2 * 8/2011 Ruhlman ..... F42B 12/04 102/382
8,240,252 B2 8/2012 Maljkovic et al.
8,408,137 B2 4/2013 Battaglia
8,443,730 B2 5/2013 Padgett
8,561,543 B2 10/2013 Burrow
8,763,535 B2 * 7/2014 Padgett ..... F42B 5/313 102/466
8,813,650 B2 8/2014 Maljkovic et al.
8,869,702 B2 10/2014 Padgett
9,032,855 B1 * 5/2015 Foren ..... F42B 33/00 102/466
9,182,204 B2 11/2015 Maljkovic et al.
9,188,412 B2 11/2015 Maljkovic et al.
9,335,137 B2 5/2016 Maljkovic et al.
2001/0013299 A1 8/2001 Husseini et al.
2002/0035946 A1 3/2002 Jamison et al.
2003/0019385 A1 1/2003 LeaSure et al.
2003/0131751 A1 7/2003 MacKerell et al.
2003/0181603 A1 9/2003 Venderbosch et al.
2004/0096539 A1 5/2004 McCaffrey et al.
2004/0211668 A1 10/2004 Montminy et al.
2005/0005807 A1 1/2005 Wiley et al.
2005/0016414 A1 1/2005 Leitner-Wise
2005/0049355 A1 3/2005 Tang et al.
2005/0066805 A1 3/2005 Park et al.
2005/0188879 A1 9/2005 Wiley et al.
2006/0013977 A1 1/2006 Duke et al.
2006/0056958 A1 3/2006 Gaines et al.
2006/0069236 A1 3/2006 Brunelle et al.
2006/0102041 A1 5/2006 Wiley et al.
2006/0105183 A1 5/2006 Chu et al.
2006/0207464 A1 9/2006 Maljkovic et al.
2007/0172677 A1 7/2007 Biermann et al.
2007/0261587 A1 11/2007 Chung
2008/0017026 A1 1/2008 Dondlinger et al.
2009/0211483 A1 8/2009 Kramer et al.
2010/0016518 A1 1/2010 El-Hibri et al.
2010/0282112 A1 11/2010 Battaglia
2011/0214583 A1 9/2011 Dutch
2012/0024183 A1 2/2012 Klein
2012/0052222 A1 3/2012 Gagne
2012/0111219 A1 5/2012 Burrow
2012/0180687 A1 7/2012 Padgett et al.
2012/0180688 A1 7/2012 Padgett
2013/0014664 A1 1/2013 Padgett
2013/0014665 A1 1/2013 Maljkovic et al.
2013/0186294 A1 7/2013 Davies et al.
2014/0060372 A1 3/2014 Padgett et al.
2014/0060373 A1 * 3/2014 Maljkovic ..... F42B 5/307 102/467
2014/0076188 A1 3/2014 Maljkovic et al.
2014/0290522 A1 10/2014 Padgett et al.
2015/0033970 A1 2/2015 Maljkovic et al.
2015/0047527 A1 2/2015 Padgett
2015/0316361 A1 11/2015 Maljkovic
2016/0025464 A1 1/2016 Maljkovic et al.
2016/0040970 A1 2/2016 Maljkovic et al.

FOREIGN PATENT DOCUMENTS

EP 222827 B1 5/1991
EP 436111 A2 7/1991
FR 861071 A 1/1941
GB 672706 A 5/1952
GB 732633 A 6/1955
GB 1568545 A 5/1980
WO 8300213 A1 1/1983
WO 8606466 A1 11/1986
WO 8907496 A1 8/1989
WO 9207024 A1 4/1992
WO 9513516 A1 5/1995

(56) References Cited

FOREIGN PATENT DOCUMENTS

| | | | |
|---|---|---|---|
| WO | 9839250 | A1 | 9/1998 |
| WO | 2008090505 | A2 | 7/2008 |
| WO | 2013016730 | A1 | 1/2013 |
| WO | 2015130409 | A2 | 9/2015 |
| WO | 2015154079 | A1 | 10/2015 |

OTHER PUBLICATIONS

International Search Report and Written Opinion for International Application PCT/US2012/048848, completed Oct. 12, 2012, 8 pgs.
International Search Report and Written Opinion for International Application PCT/US2015/0011238, Report Completed Sep. 1, 2015, Mailed Sep. 30, 2015, 10 pgs.
International Search Report and Written Opinion for International Application PCT/US2015/024528, Report Completed Jun. 16, 2015, Mailed Jul. 8, 2015, 7 pgs.
IPRP for International Application No. PCT/US2012/048848, Search Completed Jan. 28, 2014, 7 pgs.
Extended European Search Report for European Application EP12817294.7, Report completed Aug. 12, 2014, Mailed Aug. 19, 2014, 7 Pgs.
"A Guide to Polycarbonate in General", Engineering Polymer Specialists Polymer Technology & Services, LLC, pp. 1-5.
"Develoment Product Makrolon® DPI-1848, Polycarbonate Copolymer Resin General Purpose Grade", Bayer Polymers, May 2003, pp. 1-4.
"GE Plastics, Lexan® EXL9330 Americas: Commercial", General Electric Company, Sep. 29, 2004, pp. 1-5.
"Low Temperature Notched Izod Impact of RADEL R-5xxx Resins", File No. 2803, Solvay Advanced Polymers, L.L.C., Jan. 7, 1999, 1 pg.
"Preliminary Product Data, RTP 1899A X 83675 Polycarbonate/Acrylic Alloy (PC/PMMA) Thin Wall Grade", RTP Company Product Data Sheet, available at http://www.rtpcompany.com/info/data/1800A/RTP1899AX83675.htm, printed, Mar. 7, 2005, 5 pgs.
"Standard Test Methods for Determining the Izod Pendulum Impact Resistance of Plastics,1", ASTM Designation: D256-00, Jan. 2001, pp. 1-19.
Baldwin et al., "A microcellular processing study of poly(ethylene terephthalate) in the amorphous and semicrystalline states. Pat I : microcell nucleation", Society of Plastics Engineers, Polymer Engineering and Science (1996), vol. 36 (11), pp. 1437-1445.
Naitove, "Self-reinforcing thermoplastic is harder, stronger, stiffer without added fibers", Plastics Technology, Gardner Publication Inc., Jul. 2003, 2 pgs.

* cited by examiner

METHOD FOR PRODUCING SUBSONIC AMMUNITION CASING

CROSS-REFERENCE TO RELATED APPLICATIONS

The present application claims priority to U.S. Provisional Patent Application No. 61/975,497, filed Apr. 4, 2014, the disclosure of which is incorporated herein by reference.

FIELD OF THE INVENTION

The present invention generally relates to methods of manufacturing ammunition articles; and more particularly to methods of manufacturing subsonic ammunition articles from conventional ammunition articles.

BACKGROUND

Two types of ammunition are generally recognized; traditional supersonic ammunition, which fire projectiles with velocities exceeding the speed of sound (which depends on the altitude and atmospheric conditions but is generally in the range of 1,000-1,100 feet per second (fps), most commonly given at 1,086 fps at standard atmospheric conditions), and subsonic ammunition which fire projectiles with velocities less than that of the speed of sound. The lower speed of subsonic ammunition makes it much quieter than typical supersonic ammunition. Ideally, these subsonic rounds need to work interchangeably with supersonic rounds, i.e., fit properly in the same firearm chamber.

SUMMARY OF THE INVENTION

An apparatus in accordance with embodiments of the invention implement apparatus and methods for manufacturing subsonic ammunition casings.

Many embodiments are directed to a method of producing a subsonic ammunition article including:

- providing a conventional supersonic ammunition article, the article having a primer end having a primer hole disposed therein, and a neck end having a neck hole disposed therein, and the article further having an outer wall defining an internal cavity therebetween, the internal cavity defining a first volume;
- forming an access hole in the outer wall of the ammunition article;
- inserting a core pin having a body defining a second volume through one of either the neck or primer holes and into the internal cavity such that a first end of the core pin is disposed within the neck hole and occludes at least a portion of the neck end of the ammunition article, and such that a second end of the core pin is disposed within the primer hole of the ammunition article;
- inserting a filler material through the access hole in the outer wall of the ammunition article such that the filler fills a space within the internal cavity formed between the outer wall of the ammunition article and the body of the core pin;
- solidifying the filler material within the space such that the access hole is occluded by the filler material;
- removing the core pin from the ammunition article to expose a subsonic internal cavity having the second volume; and
- wherein the second volume is at least 20% less than the first volume and is configured to hold a propellant charge having a charge density of at least 20% and being capable of propelling a projectile at no greater than a subsonic velocity without exceeding the maximum pressure limit of the ammunition article.

In some embodiments the filler material is a metal, polymeric material or thermosetting material.

In other embodiments the filler material is a polymeric material selected from the group consisting of polyamides, polyimides, polyesters, polycarbonates, polysulfones, polylactones, polyacetals, acrylontrile/butadiene/styrene copolymer resins, polyphenylene oxides, ethylene/carbon monoxide copolymers, polyphenylene sulfides, polystyrene, styrene/acrylonitrile copolymer resins, styrene/maleic anhydride copolymer resins, aromatic polyketones and mixtures thereof.

In still other embodiments the second volume is at least 40% less than the first volume and the charge density is at least 40%.

In yet other embodiments the second volume is at least 60% less than the first volume and the charge density is at least 60%.

In still yet other embodiments the second volume is at least 80% less than the first volume and the charge density is at least 80%.

In still yet other embodiments the charge density is at least 90%.

In still yet other embodiments inserting the filling material comprises one of either a die casting or injection molding process.

In still yet other embodiments the core pin has an outer contour selected from the group of straight walled, concave, convex, curve, arced, ellipsoid, or a combination thereof.

In still yet other embodiments the standard velocity deviation of the ammunition article is no greater than 5 fps.

In still yet other embodiments the ammunition article has a caliber selected from the group of .22, .22-250, .223, .243, .25-06, .270, .300, .30-30, .30-40, 30.06, .303, .308, .357, .38, .40, .44, .45, .45-70, .50 BMG, 5.45 mm, 5.56 mm, 6.5 mm, 6.8 mm, 7 mm, 7.62 mm, 8 mm, 9 mm, 10 mm, 12.7 mm, 14.5 mm, 20 mm, 25 mm, 30 mm, and 40 mm.

Other embodiments are directed to an apparatus for manufacturing a subsonic ammunition article including:

- a boring machine for forming an access hole in the outer wall of an ammunition article;
- a core pin having a body defining a volume and having first and second ends, the first end configured to be disposed within a neck hole of the ammunition article such that it occludes at least a portion of a neck end of the ammunition article, and the second end configured to be disposed within a primer hole of the ammunition article; and
- a source of filler material disposed in fluid communication with the access hole ammunition article; and
- wherein the volume of the core pin is at least 20% less than the volume of the ammunition article and is configured to hold a propellant charge having a charge density of at least 20% and being capable of propelling a projectile at no greater than a subsonic velocity without exceeding the maximum pressure limit of the ammunition article.

In some embodiments the filler material is a metal, polymeric material or thermosetting material.

In other embodiments the filler material is a polymeric material selected from the group consisting of polyamides, polyimides, polyesters, polycarbonates, polysulfones, polylactones, polyacetals, acrylontrile/butadiene/styrene copolymer resins, polyphenylene oxides, ethylene/carbon monoxide copolymers, polyphenylene sulfides, polystyrene, styrene/acrylonitrile copolymer resins, styrene/maleic anhydride copolymer resins, aromatic polyketones and mixtures thereof.

In still other embodiments the second volume is at least 40% less than the first volume and the charge density is at least 40%.

In yet other embodiments the second volume is at least 60% less than the first volume and the charge density is at least 60%.

In still yet other embodiments the second volume is at least 80% less than the first volume and the charge density is at least 80%.

In still yet other embodiments the charge density is at least 90%.

In still yet other embodiments the source of filling material comprises one of either a die casting or injection molding apparatus.

In still yet other embodiments the core pin has an outer contour selected from the group of straight walled, concave, convex, curve, arced, ellipsoid, or a combination thereof.

Additional embodiments and features are set forth in part in the description that follows, and in part will become apparent to those skilled in the art upon examination of the specification or may be learned by the practice of the invention. A further understanding of the nature and advantages of the present invention may be realized by reference to the remaining portions of the specification and the drawings, which forms a part of this disclosure.

BRIEF DESCRIPTION OF THE DRAWINGS

The description will be more fully understood with reference to the following figures, which are presented as approximate schematics of exemplary embodiments of the invention and should not be construed as a complete recitation of the scope of the invention or as providing accurate relative dimensions thereof, wherein.

DETAILED DESCRIPTION

Turning now to the drawings, apparatus and methods for manufacturing subsonic ammunition articles from conventional supersonic ammunition articles are illustrated. In embodiments, the apparatus include devices for controllably introducing a filler material to reduce the inner volume of a conventional supersonic ammunition article. In many embodiments such subsonic ammunition article manufacturing apparatus includes at least a filler material introducing apparatus, which may in some embodiments include sprues, runners and gates. In other embodiments such subsonic ammunition article manufacturing apparatus includes a core pin configured to removably mate within the inner volume of a conventional supersonic ammunition casing to provide an inner volume boundary around which the filler material defines a new subsonic propellant volume within the inner volume of the conventional supersonic ammunition article. In still other embodiments a method for converting a conventional supersonic ammunition article to a subsonic ammunition article including defining a new subsonic propellant volume within said conventional supersonic ammunition article and controllably introducing a filler material therearound is also provided.

Figure 1:
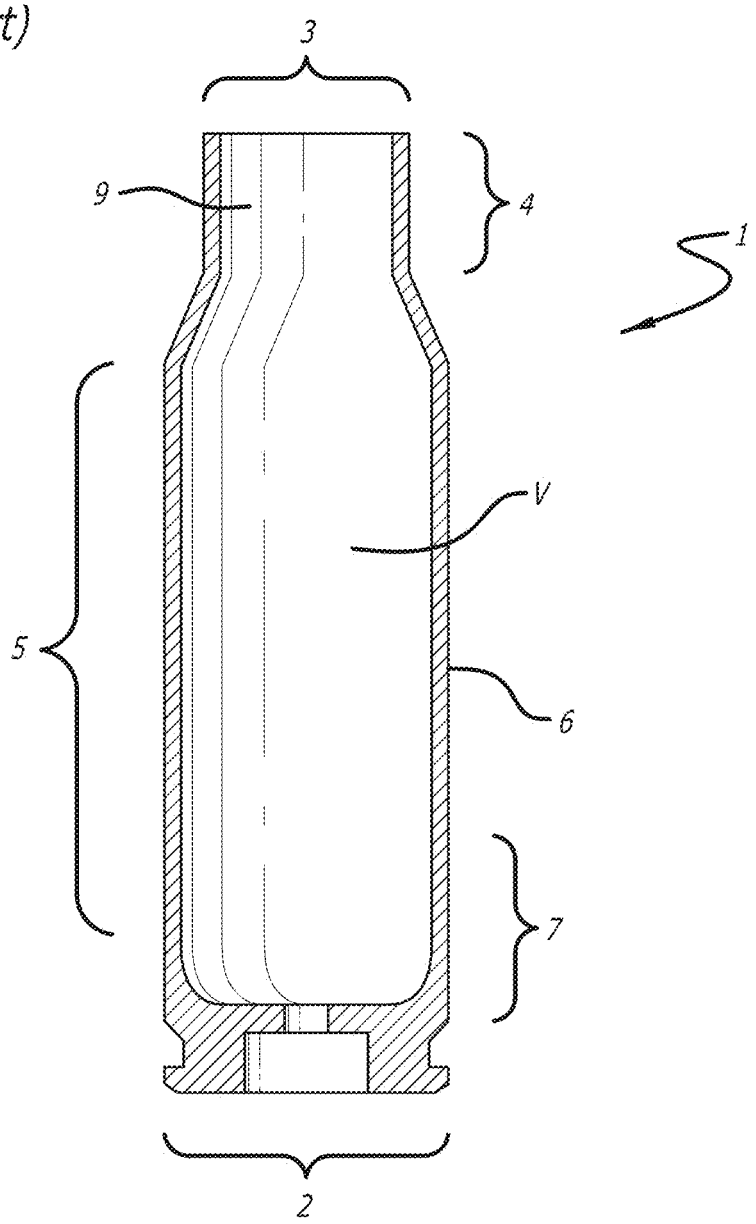
FIG. 1 (Prior Art)
FIG. 1 illustrates a cross-sectional view of a conventional supersonic ammunition casing.

FIG. 1 shows a cross-sectional view of a conventional brass, steel or aluminum ammunition article, namely a cartridge casing, used for supersonic and subsonic ammunition. As shown, the conventional cartridge casing article (1) is a one-component deep-drawn item defining an inner volume (V), the casing article having a primer end (2) and a projectile end (3) and can be divided into a neck portion (4) and a body portion (5). During firing, a weapon's cartridge chamber supports the majority of the cartridge casing wall (6) in the radial direction, but, in many weapons, a portion of the cartridge base end (7) near the primer end (2) is unsupported. During firing, a stress profile is developed along the cartridge casing, with the greatest stresses being concentrated at the base end (7). Therefore, the cartridge base end must possess the greatest mechanical strength, while a gradual decrease in material strength is acceptable in metal cartridges axially along the casing toward the projectile end (3).

The traditional route to manufacturing subsonic rounds has been to simply reduce the propellant charge in a conventional supersonic round until the velocity is adequately reduced. The problem with this approach is that reducing the propellant charge leaves a relatively large empty volume inside the case, in which the vacated propellant charge used to be stored. This large empty volume inhibits proper propellant burn, results in inconsistent propellant positioning, shows reduced accuracy and, in special situations, may lead to extremely high propellant burn rates or even propellant detonation, an extremely dangerous situation for the weapon user. One example of the deficiency of such reduced propellant volume solutions to subsonic round engineering is that since the propellant is free to move in the large empty volume, shooting upward with the propellant charge near the primer can give different velocity results than when shooting downward with the propellant charge forward, as discussed in greater detail in US Pat Pub 2014/0060373, the disclosure of which is incorporated herein by reference.

Additionally, usage of subsonic ammunition and its attendant lower combustion pressures, frequently results in the inability to efficiently cycle the ammunition in semi-automatic or fully automatic weapons, such as M16, M4, AR10, M2, M107s and the like. For repeating weapons to properly cycle, the propellant charge must produce sufficient gas pressure and/or volume to accelerate the projectile and to cycle the firing mechanism. Typical chamber pressures will be in the range from 30,000 psi to 70,000 psi. With a reduced quantity of propellant, subsonic ammunition generally fails to produce sufficient pressure to properly cycle the firing mechanism.

Over the years, a variety of attempts to safely and economically address these issues have been made. These included introduction of inert fillers, expandable inner sleeves that occupy the empty space between the propellant and the projectile (U.S. Pat. No. 4,157,684), insertion of flexible tubing (U.S. Pat. No. 6,283,035), foamed inserts (U.S. Pat. No. 5,770,815), stepped down stages in the discharge end of cartridge casings (U.S. Pat. No. 5,822,904), polymeric cases with increased wall thickness ratios (US Pat Pub 2014/0060373), or complicated component cartridges with rupturable walls and other engineered features (U.S. Pat. No. 4,958,567), all of which are incorporated herein by reference. Another approach has been to use standard cartridges in combination with non-standard propellants (US Pat Pub 2003/0131751). The result of such prior attempts to solve the production of reliable subsonic cartridges have been subsonic rounds that either have a larger spread in velocity and thus less accuracy than is desired and/or production costs that are significantly higher than full velocity rounds.

In embodiments of the method and apparatus for producing subsonic ammunition articles a conventional supersonic article is used as the foundation for the subsonic article, and a new internal volume for holding the propellant is engineered within the internal volume of the conventional supersonic ammunition article.

The term "ammunition article" as used herein refers to a complete, assembled round of ammunition that is ready to be loaded into a firearm and fired. An ammunition article may be a live round fitted with a projectile, or a blank round with no projectile. An ammunition article may be any caliber of pistol or rifle ammunition and may also be other types such as non-lethal rounds, rounds containing rubber bullets, rounds containing multiple projectiles (shot), and rounds containing projectiles other than bullets such as fluid-filled canisters and capsules. The cartridge casing is the portion of an ammunition article that remains intact after firing. A cartridge casing may be one-piece or it may consist of two components or even higher number of components. Many different types and calibers of ammunition articles are proposed for use with embodiments of the apparatus and method. For example, polymeric materials that meet design guidelines may be used to produce subsonic ammunition components for various calibers of firearms. Non limiting examples include .22, .22-250, .223, .243, .25-06, .270, .300, .30-30, .30-40, 30.06, .303, .308, .357, .38, .40, .44, .45, .45-70, .50 BMG, 5.45 mm, 5.56 mm, 6.5 mm, 6.8 mm, 7 mm, 7.62 mm, 8 mm, 9 mm, 10 mm, 12.7 mm, 14.5 mm, 20 mm, 25 mm, 30 mm, 40 mm and others.

Figure 2:
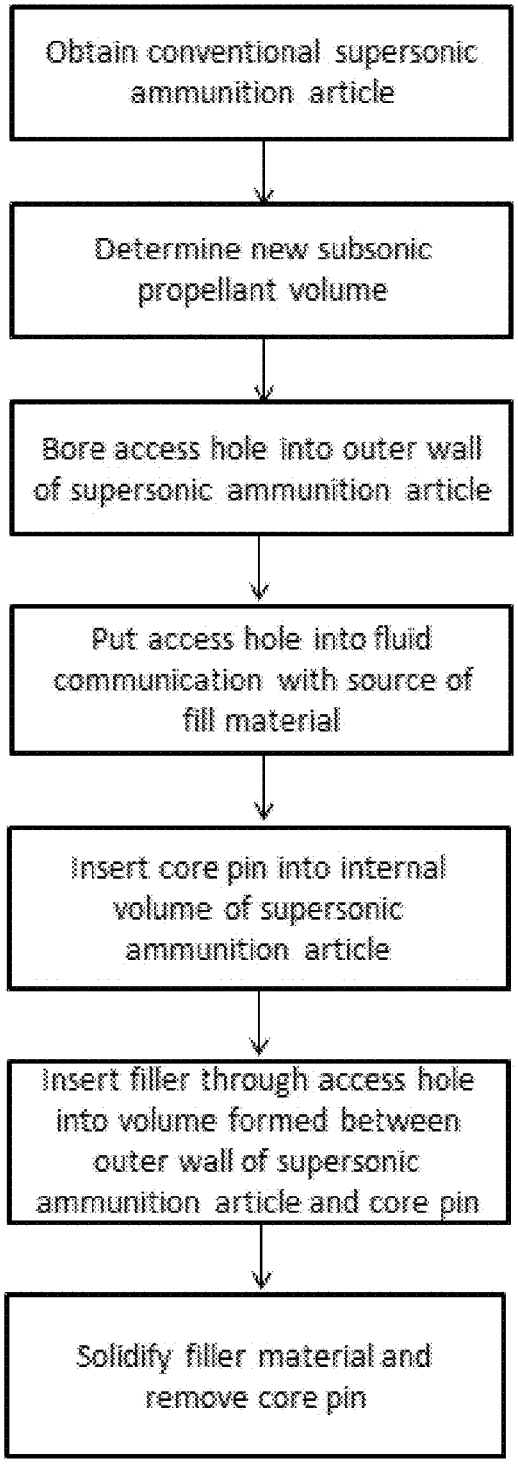
FIG. 2 illustrates a flowchart of a method of manufacturing a subsonic casing in accordance with embodiments of the invention.

A flowchart summarizing embodiments of methods for producing subsonic ammunition articles from conventional supersonic casings is provided in FIG. 2. As shown, in many embodiments the method comprises first obtaining a conventional supersonic ammunition article and determining the dimensions of a modified or reduced internal volume suitable for subsonic requirements. The term "reduced volume" as used herein shall refer to an ammunition cartridge having an internal volume that is reduced compared to the equivalent internal volume of a supersonic cartridge of the same caliber. Internal volumes of conventional supersonic casings may be known in accordance with published standards or may be determined by a volume calculation.

As an example, a typical full capacity 7.62 mm cartridge case ammunition article will have a capacity of between 45 and 60 grains of water (gr H2O) when full. This is defined as taking a cartridge case ammunition article (either fired or unfired), plugging the primer opening on the bottom and filling the cartridge internal volume with a quantity of water to be level with the case mouth. This quantity of water is weighed and resulting value represents the internal volume of the case article. This can be converted to volume units, such as cubic inch, milliliter or cubic centimeter. Usage of grains of water unit is purely for convenience as the weighing equipment is readily available within the art, and this unit is familiar within the art and is used in popular internal ballistic calculation software such as for example Quickload™ by NECO™. This reduced volume cartridge can be used for subsonic ammunition or for supersonic ammunition with reduced propellant loads.

As described above, the reduced internal volume of the subsonic ammunition article is configured to hold a smaller quantity of propellant when full in comparison to a full capacity ammunition article of the same caliber. The dimensions of the internal volume of the subsonic ammunition article are configured with reference to two features of the propellant charge: 1) the charge of propellant needed to propel a projectile from the ammunition article at a suitable subsonic velocity; and 2) volume needed to hold such a propellant charge with the maximum charge density permitted before the maximum chamber pressure of the ammunition article is exceeded.

As discussed, the amount of internal volume reduction is determined by exact need for the propellant charge in order to meet the subsonic projectile requirement, i.e., a propellant charge that does not allow the projectile to fire at a speed exceeding the speed of sound ~1,086 fps at standard atmospheric conditions. Determining such a propellant charge may be made using any conventional ballistics testing or modeling technique such as may be known to one of ordinary skill in the art. Non-limiting amounts of internal volume reduction in a cartridge casing are about 20%, more preferably about 30%, even more preferably about 40%, still more preferably about 50%, yet more preferably about 60%, even more preferably about 70%, more preferably about 80% and up.

Likewise, the term "charge density" as used herein shall refer to the percentage of the internal volume of an ammunition casing occupied by the propellant. Non-limiting charge density values are more than about 20%, more preferably greater than 30%, even more preferably greater than 40%, still more preferably greater than 50%, yet more preferably greater than 60%, even more preferably greater than 70%, more preferably greater than 80 and most preferably greater than 90%. In accordance with embodiments of the apparatus and method the charge density should be maximized while not exceeding the maximum chamber pressure values in the safe zone for the operation of the weapon. It should be understood that the maximum chamber pressure is a value known in the art or obtainable by conventional ballistics and materials testing.

It is understood that depending on the application a variety of differing propellants can be used, from very fast burning pistol and shotgun propellants to very slow large rifle propellants. As a non-limiting example, all of the propellants on the widely available propellant burn chart can be used in practice of embodiments of the apparatus and methods.

Figure 3A:
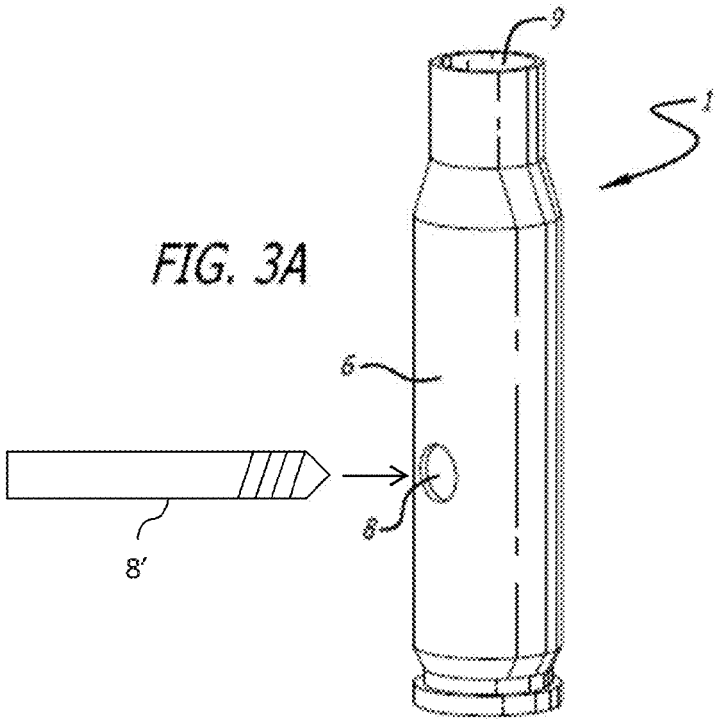
FIGS. 3*a* to 3*e* illustrate perspective views of the manufacture of a supersonic ammunition casing in accordance with embodiments of the invention.

Once an appropriate subsonic internal volume has been determined, the outer wall (6) of the supersonic ammunition casing article (1) is perforated to form an access hole (8) to its internal volume (V), as shown in FIG. 3*a*. This access hole will later be used to inject a filler material into the internal volume of the supersonic ammunition article. In embodiments the access hole may be made by any suitable method (8') including drilling, boring, cutting, etc.

Figure 3B:
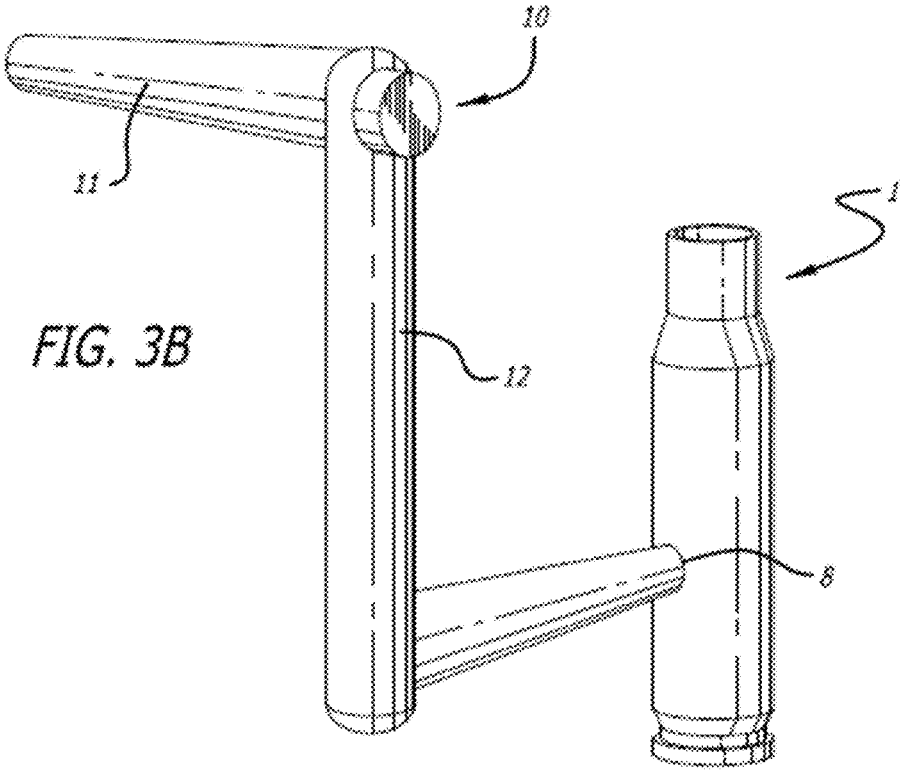
Figure 4:
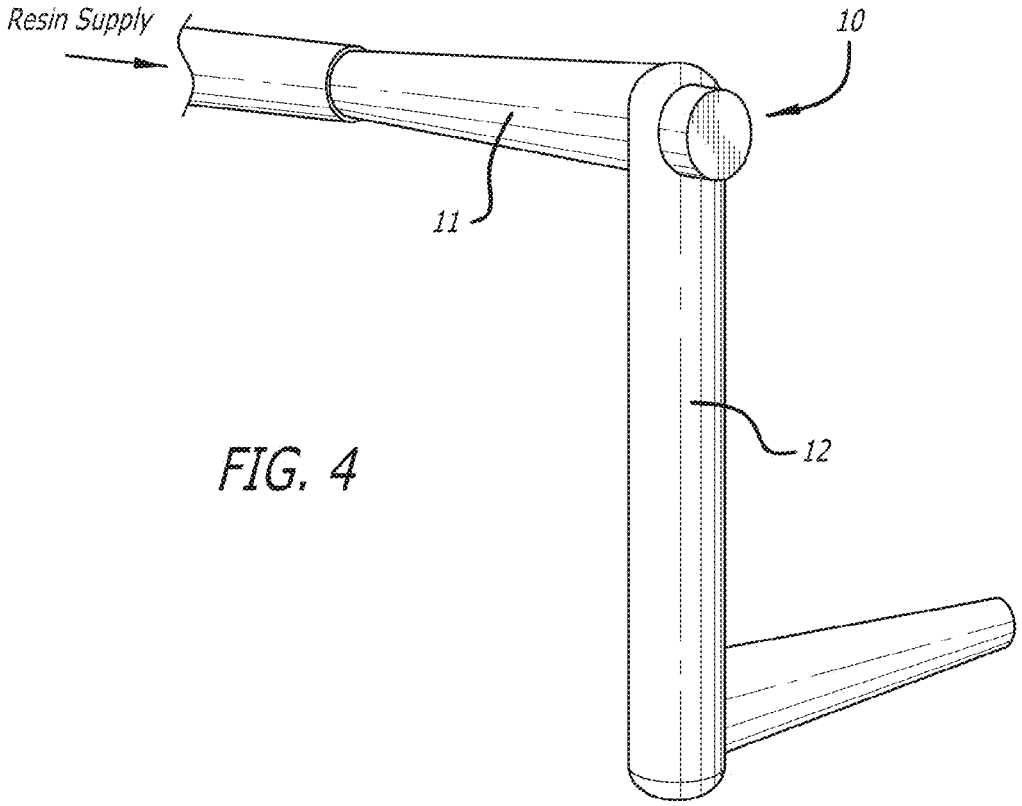
FIG. 4 illustrates a perspective of a filler feed mechanism for the manufacture of a subsonic casing in accordance with embodiments of the invention.

Once the access hole (8) has been made in the outer wall (6) of the casing article (1), it is placed into fluid communication with a source of a filler material. In exemplary embodiments such filler source may include an injection molding or die casting device. One exemplar of a filler source fluid pathway (10), including gates (11) and runners (12) is shown schematically in FIG. 4. Although one embodiment of a filler fluid pathway (10 to 12) in conjunction with an ammunition article (1) is shown in FIG. 3*b*, it should be understood that any suitable fluid pathway arrangement may be used in association with the method and apparatus such that a molten filler material (13) may be controllably introduced into the internal volume (V) of the ammunition article (1) through the access hole (8). Although the location of the gate (12) is an important parameter in the art of molding and casting, it is understood that the person skilled in the art can place the gate location where it can meet the demands of the production and that it can be anywhere along the length of the ammunition article outer wall.

Figure 3C:
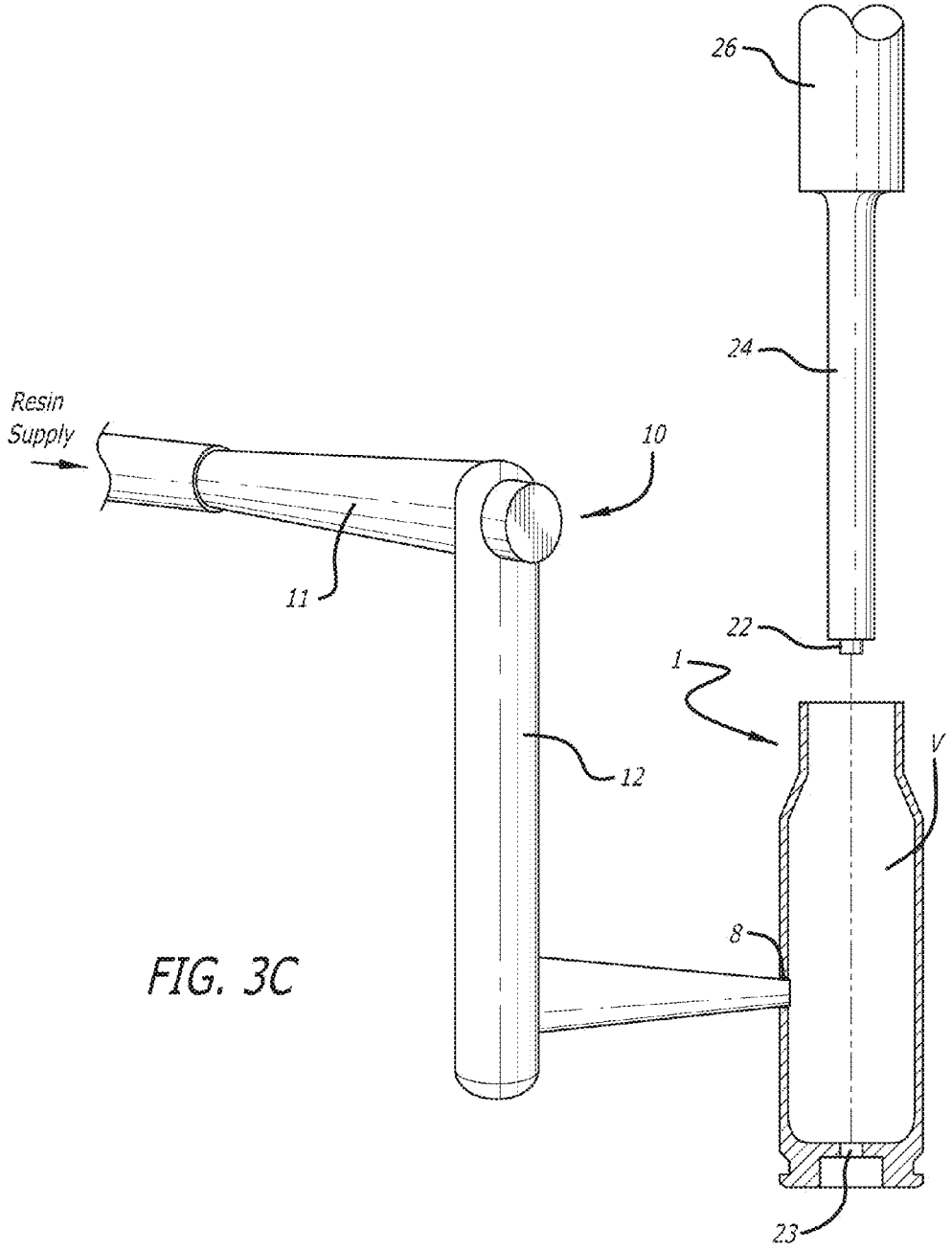

As shown in FIG. 3*c*, to establish the new internal volume a core pin (20) having a body with a volume and external dimensions that conform to the desired modified subsonic volume of the ammunition article is inserted into the ammunition article, such that when the filler material (13) is injected into the internal volume (V) of the ammunition article (1) the filler material flows about the core pin. The volume of the filler (13) inserted into the cavity is determined by the internal standard case dimensions and the core pin which is introduced from the mouth or the primer end, depending on the configuration.

Figure 5A:
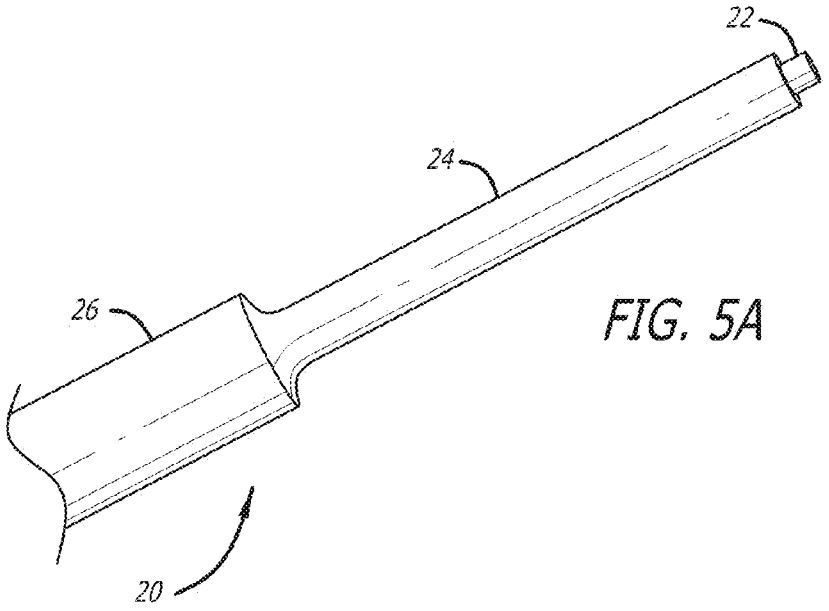
FIGS. 5A and 5B illustrate perspective views of core pins for use in the manufacture of subsonic casing in accordance with embodiments of the invention.
Figure 5B:
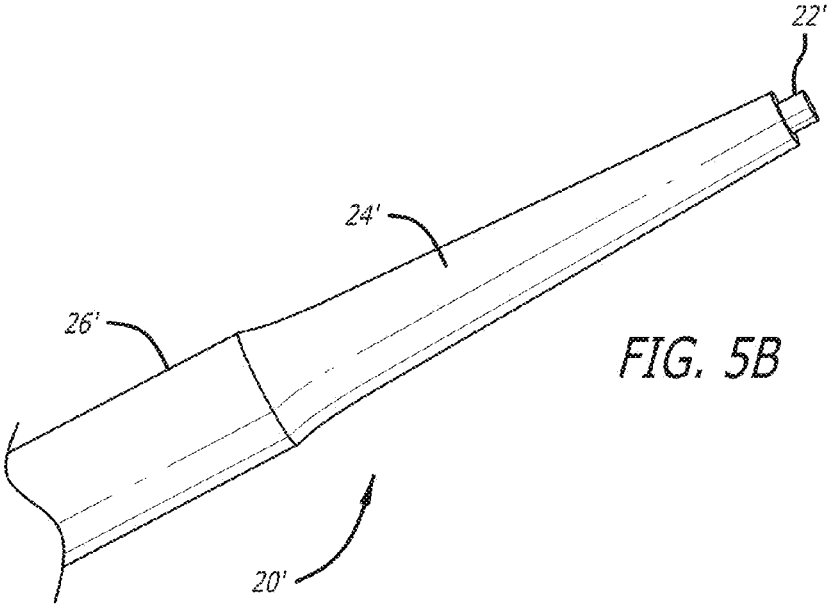

As shown in FIGS. 5*a* and 5*b*, core pins generally comprise an elongated body (20 and 20') having a distal primer end (22 and 22') which is made to mate with the flash hole (23) of the ammunition article (1), a proximal neck opening end (26 and 26') configured to set and seal the mouth (9) of the ammunition article at least a portion of the neck length (4), and a volumetric body (24 and 24') disposed therebetween. The seating of the primer end (22 and 22') within the primer hole of the ammunition article is necessary to ensure access from the primer to the charge of propellant, and the seating and sealing of the neck end (26 and 26') within the neck of the ammunition article ensures that filler material does not occlude the seating area for a projectile. Between these two points the core pin volumetric body (24 and 24') may have any volumetric configuration suitable to provide a subsonic propellant charge to the ammunition article having a high charge density.

Two non-limiting examples of suitable core pin designs are shown in FIGS. 5*a* and 5*b*, where the core pin (20) in FIG. 5*a* has a volume of approximately 14 grains of water with a mostly linear internal volume, and the core pin (20') of FIG. 5*b* has a volume of approximately 16 grains of water with mostly arced internal volume. It is understood that the core pins can be made into a variety of geometries. Geometry can be straight walled, it can have concave and/or convex features, can consist of a series of arcs in combination with linear portions, or can have ellipsoid component, etc. The exact configuration is determined by testing the proposed combination of a projectile, reduced internal volume, primer and the propellant and optimized for a desired characteristic, such as standard deviation, projectile velocity, minimizing the velocity difference between the rifle point up vs. rifle pointing down, etc. In addition, although embodiment are shown where the core pin is inserted into the neck opening of the ammunition article, in other embodiments the core pin may be inserted through the primer opening.

Figure 3D:
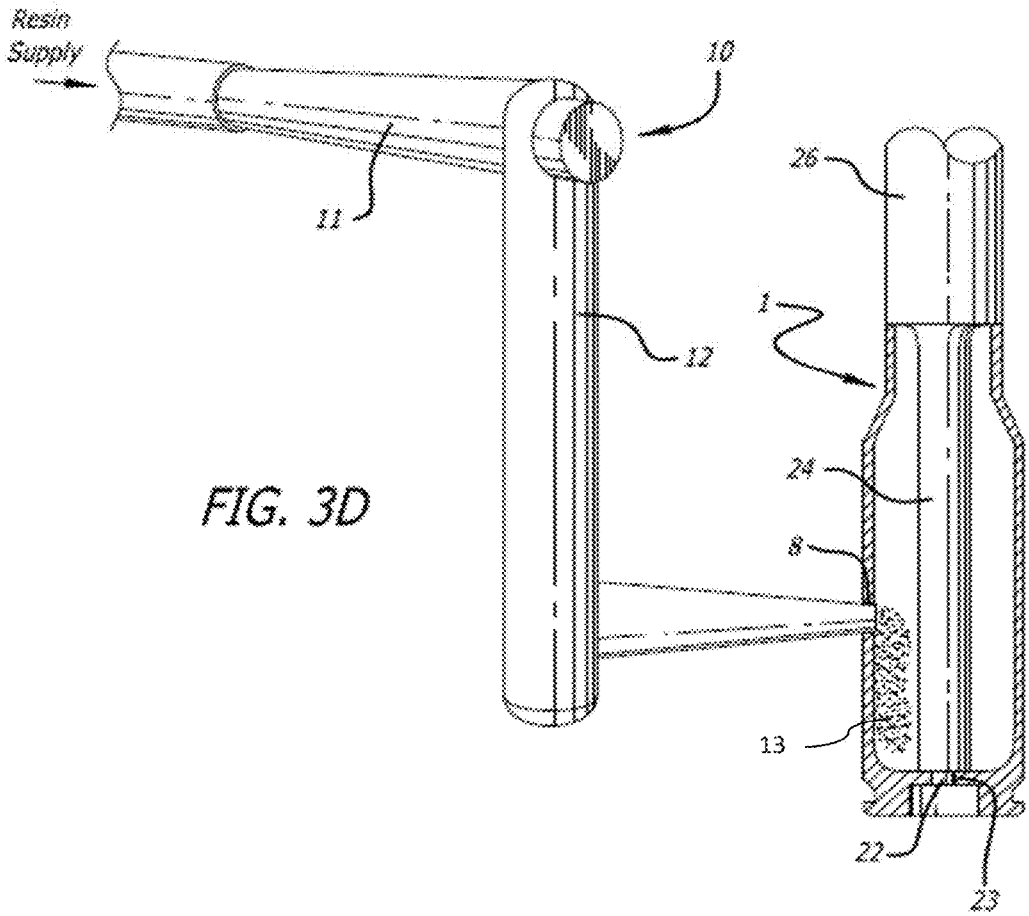
Figure 3E:
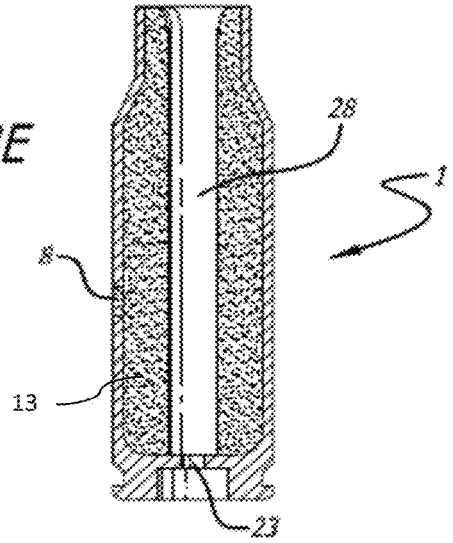

Once the access hole (8) of the ammunition article is in fluid communication with the filler source and the core pin (20) is seated within the internal volume (V) of the ammunition article a filler material, such as, for example, a polymer or metal is injected through the access hole into the modified subsonic internal volume formed between the walls (6) of the exterior of the ammunition article (1) and the outer surface of the core pin (20). The resulting volume (28) is filled with the filler material (13) and results in a restricted volume cartridge case, visible in FIGS. 3*d* and 3*e*, which have been sectioned for illustration.

The term "suitable polymeric materials" or "polymeric materials" as used herein shall refer to materials any number of polymeric materials suitable for use in ammunition casing articles. Non limiting examples include polyamides, polyimides, polyesters, polycarbonates, polysulfones, polylactones, polyacetals, acrylontrile/butadiene/styrene copolymer resins, polyphenylene oxides, ethylene/carbon monoxide copolymers, polyphenylene sulfides, polystyrene, styrene/acrylonitrile copolymer resins, styrene/maleic anhydride copolymer resins, aromatic polyketones and mixtures thereof. Also suitable are thermosetting materials such as silicones and metal injection molding formulations.

Design features can also be incorporated into the modified metallic cartridge to enhance the utility or esthetics of the article. Non limiting examples include additional holes or slots or roughening of the inside surfaces to increase the attachment of the injected filler to the modified metallic cartridge during the firing event. Additionally, adhesives and/or sealants may be used as well. Painting, cut patterns and variety of other esthetic and ornamental modifications are contemplated as well.

Exemplary Embodiments

In order to illustrate embodiments of the apparatus and methods a following non-limiting example is provided. A standard .308 cartridge was modified as described with reference to FIG. 3. In the embodiment the internal volume was limited to about 23 grains of water. A standard large rifle primer (CCI 34) was used. The propellant used was a pistol/shotgun propellant (W-231), projectile used was a 180 grains, jacketed lead projectile and the overall cartridge length was 2.735 inches. The weapon used was a 22 inch barrel .308 bolt action rifle. The standard velocity deviation of the resulting fired ammunition group was 3 feet per second (fps), while the extreme spread was 5 fps. This is an extremely close spread in comparison to conventional subsonic ammunition articles where the standard velocity deviation can be well over 100 fps.

Accordingly, methods and apparatus for manufacturing reduced volume cartridge cases and other ammunition articles are provided. The method and apparatus effectively combines historically proven metallic cartridge cases with their durability and mass production efficiency with injection molding of reduced volume materials.

DOCTRINE OF EQUIVALENTS

As can be inferred from the above discussion, the above-mentioned concepts can be implemented in a variety of arrangements in accordance with embodiments of the invention. Accordingly, although the present invention has been described in certain specific aspects, many additional modifications and variations would be apparent to those skilled in the art. It is therefore to be understood that the present invention may be practiced otherwise than specifically described. Thus, embodiments of the present invention should be considered in all respects as illustrative and not restrictive.

What claimed is:

1. A method of producing a subsonic ammunition article comprising:

providing a conventional supersonic ammunition article, the article having a primer end having a primer hole disposed therein, and a neck end having a neck hole disposed therein, and the article further having an outer wall defining an internal cavity therebetween, the internal cavity defining a first volume;

forming an access hole in the outer wall of the ammunition article;

inserting a core pin having a body defining a second volume through one of either the neck or primer holes and into the internal cavity such that a first end of the core pin is disposed within the neck hole and occludes at least a portion of the neck end of the ammunition article, and such that a second end of the core pin is disposed within the primer hole of the ammunition article;

inserting a filler material through the access hole in the outer wall of the ammunition article such that the filler fills a space within the internal cavity formed between the outer wall of the ammunition article and the body of the core pin;

solidifying the filler material within the space such that the access hole is occluded by the filler material;

removing the core pin from the ammunition article to expose a subsonic internal cavity having the second volume; and wherein the second volume is at least 20% less than the first volume.

2. The method of claim 1, wherein the filler material is a metal, polymeric material or thermosetting material.

3. The method of claim 1, wherein the filler material is a polymeric material selected from the group consisting of polyamides, polyimides, polyesters, polycarbonates, polysulfones, polylactones, polyacetals, acrylontrile/butadiene/styrene copolymer resins, polyphenylene oxides, ethylene/carbon monoxide copolymers, polyphenylene sulfides, polystyrene, styrene/acrylonitrile copolymer resins, styrene/maleic anhydride copolymer resins, aromatic polyketones and mixtures thereof.

4. The method of claim 1, wherein the second volume is at least 40% less than the first volume.

5. The method of claim 1, wherein the second volume is at least 60% less than the first volume.

6. The method of claim 1, wherein the second volume is at least 80% less than the first volume.

7. The method of claim 1, wherein the second volume is at least 70% less than the first volume.

8. The method of claim 1, wherein inserting the filling material comprises one of either a die casting or injection molding process.

9. The method of claim 1, wherein the core pin has an outer contour selected from the group of straight walled, concave, convex, curve, arced, ellipsoid, or a combination thereof.

10. The method of claim 1, wherein the ammunition article has a caliber selected from the group of .22, .22-250, .223, .243, .25-06, .270, .300, .30-30, .30-40, 30.06, .303, .308, 357, .38, .40, .44, .45, .45-70, .50 BMG, 5.45 mm, 5.56 mm, 6.5 mm, 6.8 mm, 7 mm, 7.62 mm, 8 mm, 9 mm, 10 mm, 12.7 mm, 14.5 mm, 20 mm, 25 mm, 30 mm, and 40 mm.

11. An apparatus for manufacturing a subsonic ammunition article comprising:

a boring machine for forming an access hole in an outer side wall of an ammunition article the ammunition article defining an internal volume;

a removable core pin having a body defining a volume and having first and second ends, the first end configured to be disposed within a neck hole of the ammunition article such that it occludes at least a portion of a neck end of the ammunition article, and the second end configured to be disposed within a primer hole of the ammunition article; and a source of solidifiable filler material disposed in fluid communication with a filler volume disused between the outer side wall of the ammunition casing and the core pin through the access hole of the ammunition article, the source of solidifiable filler material having sufficient filler material to fill the filler volume; and wherein the volume of the core pin is at least 20% less than internal volume of the ammunition article.

12. The apparatus of claim 11, wherein the filler material is a metal, polymeric material or thermosetting material.

13. The apparatus of claim 11, wherein the filler material is a polymeric material selected from the group consisting of polyamides, polyimides, polyesters, polycarbonates, polysulfones, polylactones, polyacetals, acrylontrile/butadiene/styrene copolymer resins, polyphenylene oxides, ethylene/carbon monoxide copolymers, polyphenylene sulfides, polystyrene, styrene/acrylonitrile copolymer resins, styrene/maleic anhydride copolymer resins, aromatic polyketones and mixtures thereof.

14. The apparatus of claim 11, wherein the volume of the core pin is at least 40% less than the internal volume.

15. The apparatus of claim 11, wherein the volume of the core pin is at least 60% less than internal volume.

16. The apparatus of claim 11, wherein the volume of the core pin is at least 80% less than the internal volume.

17. The apparatus of claim 11, wherein the volume of the core pin is at least 70% less than the internal volume.

18. The apparatus of claim 11, wherein the source of filling material comprises a fluid pathway comprising at least gates and runners.

19. The apparatus of claim 11, wherein the core pin has an outer contour selected from the group of straight walled, concave, convex, curve, arced, ellipsoid, or a combination thereof.

* * * * *